US009196202B2

(12) United States Patent
Zhang et al.

(10) Patent No.: US 9,196,202 B2
(45) Date of Patent: Nov. 24, 2015

(54) LED BACKLIGHT DRIVING CIRCUIT, LCD DEVICE, AND METHOD FOR DRIVING THE LED BACKLIGHT DRIVING CIRCUIT

(71) Applicant: SHENZHEN CHINA STAR OPTOELECTRONICS TECHNOLOGY CO., LTD., Shenzhen (CN)

(72) Inventors: Xianming Zhang, Shenzhen (CN); Xiang Yang, Shenzhen (CN)

( * ) Notice: Subject to any disclaimer, the term of this patent is extended or adjusted under 35 U.S.C. 154(b) by 315 days.

(21) Appl. No.: 13/884,641

(22) PCT Filed: Apr. 7, 2013

(86) PCT No.: PCT/CN2013/073785
§ 371 (c)(1),
(2) Date: May 10, 2013

(87) PCT Pub. No.: WO2014/153794
PCT Pub. Date: Oct. 2, 2014

(65) Prior Publication Data

US 2014/0292630 A1 Oct. 2, 2014

(30) Foreign Application Priority Data

Mar. 29, 2013 (CN) ..... 2013 1 0110134

(51) Int. Cl.
*H05B 33/08* (2006.01)
*G09G 3/36* (2006.01)
*G09G 3/34* (2006.01)

(52) U.S. Cl.
CPC ..... *G09G 3/36* (2013.01); *G09G 3/3406* (2013.01); *H05B 33/089* (2013.01)

(58) Field of Classification Search
None
See application file for complete search history.

(56) References Cited

U.S. PATENT DOCUMENTS

| | | | | |
|---|---|---|---|---|
| 7,777,704 | B2 * | 8/2010 | S et al. | 345/82 |
| 8,278,837 | B1 * | 10/2012 | Lenk | 315/291 |
| 2007/0001625 | A1 | 1/2007 | Kim | |
| 2008/0106505 | A1 * | 5/2008 | Chou | 345/83 |

(Continued)

FOREIGN PATENT DOCUMENTS

| | | | |
|---|---|---|---|
| CN | 101606439 | A | 12/2009 |
| CN | 102300376 | A | 11/2011 |

(Continued)

OTHER PUBLICATIONS

Yuan Ye, The International Searching Authority written comments, Oct. 2013, CN.

*Primary Examiner* — Seokyun Moon
*Assistant Examiner* — Josemarie G Acha, III

(57) ABSTRACT

A light emitting diode (LED) backlight driving circuit of the present disclosure includes a monitor module, a first light cluster, a first boost voltage module that drives the first light cluster, a second light cluster, and a second boost voltage module that drives the second light cluster. The first boost voltage module includes a first detection unit that detects an output current of the first boost voltage module, and the second boost voltage module includes a second detection unit that detects an output current of the second boost voltage module. The monitor module includes a current comparing unit coupled to the first detection unit and the second detection unit, and an actuator coupled to the current comparing unit. The actuator controls running states of the first boost voltage module and the second boost voltage module.

15 Claims, 3 Drawing Sheets

(56) References Cited

U.S. PATENT DOCUMENTS

| | | | | |
|---|---|---|---|---|
| 2008/0129671 | A1 | 6/2008 | Shen et al. | |
| 2008/0218100 | A1* | 9/2008 | Parikh | 315/306 |
| 2009/0160422 | A1* | 6/2009 | Isobe et al. | 323/349 |
| 2009/0184668 | A1* | 7/2009 | Mednik et al. | 315/297 |
| 2010/0033110 | A1* | 2/2010 | Chien | 315/294 |
| 2010/0052569 | A1* | 3/2010 | Hoogzaad et al. | 315/294 |
| 2010/0127672 | A1* | 5/2010 | Chen et al. | 323/222 |
| 2010/0177127 | A1* | 7/2010 | Akiyama et al. | 345/690 |
| 2010/0194299 | A1* | 8/2010 | Ye et al. | 315/192 |
| 2010/0225290 | A1* | 9/2010 | Nalbant | 323/282 |
| 2011/0115770 | A1* | 5/2011 | Seo et al. | 345/211 |
| 2011/0227503 | A1* | 9/2011 | Yuan et al. | 315/294 |
| 2012/0044268 | A1* | 2/2012 | He et al. | 345/690 |
| 2013/0002162 | A1* | 1/2013 | Gao et al. | 315/210 |
| 2013/0082613 | A1* | 4/2013 | Shin et al. | 315/186 |
| 2013/0120687 | A1* | 5/2013 | Hao et al. | 349/61 |
| 2013/0293109 | A1* | 11/2013 | Cheon et al. | 315/122 |
| 2014/0139499 | A1* | 5/2014 | Hussain et al. | 345/204 |

FOREIGN PATENT DOCUMENTS

| | | | |
|---|---|---|---|
| CN | 102573203 | A | 7/2012 |
| CN | 102622968 | A | 8/2012 |
| CN | 102740535 | A | 10/2012 |
| JP | 2002231034 | A | 8/2002 |
| JP | 2004-145321 | A | 5/2004 |

* cited by examiner

LED BACKLIGHT DRIVING CIRCUIT, LCD DEVICE, AND METHOD FOR DRIVING THE LED BACKLIGHT DRIVING CIRCUIT

This application is a national stage application of PCT application PCT/CN2013/073785 filed on Apr. 7, 2013, which is based on and claims priority to Chinese patent application 201310110134.4 filed on Mar. 29, 2013 in China. The entirety of each of the above-mentioned applications is hereby incorporated by reference herein in its entirety.

TECHNICAL FIELD

The present disclosure relates to the field of a liquid crystal display (LCD), and more particularly to a light emitting diode (LED) backlight driving circuit, an LCD device, and a method for driving the LED backlight driving circuit.

BACKGROUND

A typical backlight driving of a liquid crystal (LC) panel uses a light emitting diode (LED) as a backlight source. One system uses a plurality of LEDs connected in series to form a lightbar driven to light by a boost voltage circuit. The typical backlight driving has no electrical leakage protection, so if a user touches a television or other liquid crystal display device that are in an electrical leakage state, the user may get shocked and it is dangerous.

SUMMARY

In view of the above-described problems, the aim of the present disclosure is to provide a light emitting diode (LED) backlight driving circuit, a liquid crystal display (LCD) device, and a method for driving, the LED backlight driving circuit capable of having electrical leakage protection.

The aim of the present disclosure is achieved by the following methods.

The LED backlight driving circuit comprises a monitor module, a first light cluster, a first boost voltage module that drives the first light cluster, a second light cluster, and a second boost voltage module that drives the second light cluster. The first boost voltage module comprises a first detection unit that detects an output current of the first boost voltage module, and the second boost voltage module comprises a second detection unit that detects an output current of the second boost voltage module. The monitor module comprises a current comparing unit coupled to the first detection unit and the second detection unit, and an actuator coupled to the current comparing, unit. The actuator controls running, states of the first boost voltage module and the second boost voltage module.

In one example, a resistance value of the first light cluster is equal to a resistance value of the second light cluster. According to Ohm's law, when resistance and voltage are same, current is also same. Regardless of brightness of the light cluster in a normally working state, the difference value between load current of the first light cluster and load current of the second light cluster may be zero, namely reference value is constant. As long as one of the two light clusters is electrical leakage, the difference value between the load current of the first light cluster and the load current of the second light cluster may not be zero. Thus, when the difference value between the load current of the first light cluster and the load current of the second light cluster may not be zero, it is determined that the LCD device is in the electrical leakage state, thus reducing error determination.

In one example, the first light cluster is same as the second light cluster. The present disclosure is particularly suitable for to the LED backlight driving circuit of the LCD device using a method for illuminating the LCD device from the two sides of the LCD device, namely the first light cluster and the second light cluster are arranged on two opposite sides of the LCD device, respectively, and the light enters into the LCD device from the two opposite sides of a liquid crystal panel of the LCD device.

In one example, the LED backlight driving circuit comprises a power source. The first boost voltage module comprises a first inductor and a first diode, the first inductor and the first diode are connected between the power source and the first light cluster in series. An anode of the first diode is coupled to the first inductor and is connected to a first adjusting voltage switch, a cathode of the first diode is coupled to the first light cluster, and a first capacitor is connected between the cathode of the first diode and a ground end of the LED backlight driving circuit. The first detection unit comprises a first resistor connected between the first adjusting voltage switch and the ground end of the LED backlight driving circuit in series, a first end of the first resistor that connected to the adjusting voltage switch is coupled to the current comparing unit of the monitor module, and a control end of the first adjusting voltage switch is coupled to the monitor module. The second boost voltage module comprises a second inductor and a second diode, the second inductor and the second diode are connected between the power source and the second light cluster in series; an anode of the second diode is coupled to the second inductor and is connected to a second adjusting voltage switch, a cathode of the second diode is coupled to the second light cluster, and a second capacitor is connected between the cathode of the second diode and the ground end of the LED backlight driving circuit. The second detection unit comprises a second resistor connected between the second adjusting voltage switch and the ground end of the LED backlight driving circuit in series, a first end of the second resistor that connected to the second adjusting voltage switch is coupled to the current comparing unit of the monitor module, and a control end of the second adjusting voltage switch is coupled to the monitor module. This is a special driving circuit of the first light cluster and the second light cluster.

In one example, a third dimming switch and a third resistor are connected between the first light cluster and the ground end of the LED backlight driving circuit in series, a control end and an output end of the third dimming switch are coupled to the monitor module, a fourth dimming switch and a fourth resistor are connected between the second light cluster and the ground end of the LED backlight driving circuit in series, and a control end and an output end of the fourth dimming switch are coupled to the monitor module. This is a special driving circuit of the first light cluster and the second light cluster that have a dimming function.

In one example, a resistance value of the first light cluster is equal to a resistance value of the second light cluster, and the first light cluster is same as the second light cluster. The LED backlight driving circuit comprises a power source. The first boost voltage module comprises a first inductor and a first diode, the first inductor and the first diode are connected between the power source and the first light cluster in series. An anode of the first diode is coupled to the first inductor and is connected to a first adjusting voltage switch, a cathode of the first diode is coupled to the first light cluster, and a first capacitor is connected between the cathode of the first diode and a ground end of the LED backlight driving circuit. The first detection unit comprises a first resistor connected between the first adjusting voltage switch and the ground end of the LED backlight driving circuit in series, a first end of the first resistor that connected to the adjusting voltage switch is coupled to the current comparing unit of the monitor nodule, and a control end of the first adjusting voltage switch is coupled to the monitor module. The second boost voltage module comprises a second inductor and a second diode, the second inductor and the second diode are connected between the power source and the second light cluster in series; an anode of the second diode is coupled to the second inductor and is connected to a second adjusting voltage switch, a cathode of the second diode is coupled to the second light cluster, and a second capacitor is connected between the cathode of the second diode and the ground end of the LED backlight driving circuit. The second detection unit comprises a second resistor connected between the second adjusting voltage switch and the ground end of the LED backlight driving circuit in series, a first end of the second resistor that connected to the second adjusting voltage switch is coupled to the current comparing unit of the monitor module, and a control end of the second adjusting voltage switch is coupled to the monitor module. A third dimming switch and a third resistor are connected between the first light cluster and the ground end of the LED backlight driving circuit in series, a control end and an output end of the third dimming switch are coupled to the monitor module, a fourth dimming switch and a fourth resistor are connected between the second light cluster and the ground end of the LED backlight driving circuit in series, and a control end and an output end of the fourth dimming switch are coupled to the monitor module. This is special the LED backlight driving circuit.

A method for driving the LED backlight driving circuit of the present disclosure, comprising:

A: detecting a difference value of current between a first detection unit and a second detection unit in a normally working, state, and setting the difference value as a reference difference value.

B: detecting the difference value of current between the first detection unit and the second detection unit in a working state. If the difference value is more than the reference difference value, outputs of the first boost voltage module and the second boost voltage module are turned off, and if the difference value is equal to the reference difference value, returning to the step B.

In one example, the step A comprises: detecting the difference value of current between the first detection unit and the second detection unit in a maximum brightness state of the LED lightbar, and setting the difference value as the reference value. When brightness of the LED lightbar is maximum, currents of a first light cluster and a second light cluster are maximum, thus the difference value of current between the first light cluster and the second light cluster set as the reference difference value is maximum, if the difference value of between current of the first detection unit and current of the second detection unit in the working state exceeds the reference difference value, the electrical leakage is basically determined, which improves accuracy of determination and reduces error determination.

An LCD device comprises an LED backlight driving, circuit of the present disclosure.

In one example, the LCD device comprises a liquid crystal panel. The first light cluster and the second light cluster are arranged on two opposite sides of the liquid crystal panel.

The present disclosure provides two light clusters comprising the LED lightbar, and the two light clusters are respectively driven by two boost voltage modules. The current comparing unit of the monitor module compares waveforms of the output currents of the two boost voltage modules. When the LED backlight driving circuit normally works, a difference value between a load current of the first light cluster and a load current of the second light cluster is substantially constant. When one of the two light clusters is in an electrical leakage state, the output current of the boost voltage module corresponding to the light cluster of the electric leakage increases. The output current of the other boost voltage module corresponding to the light cluster having no electrical leakage is not changed, thus the difference value between the load current of the first light cluster and the load current of the second light cluster increases. It is determined whether the light cluster is in the electrical leakage state or not through the above method. When the LED backlight driving circuit is in the electrical leakage state, the boost voltage module turns off, thereby protecting the user.

DETAILED DESCRIPTION

Figure 1:
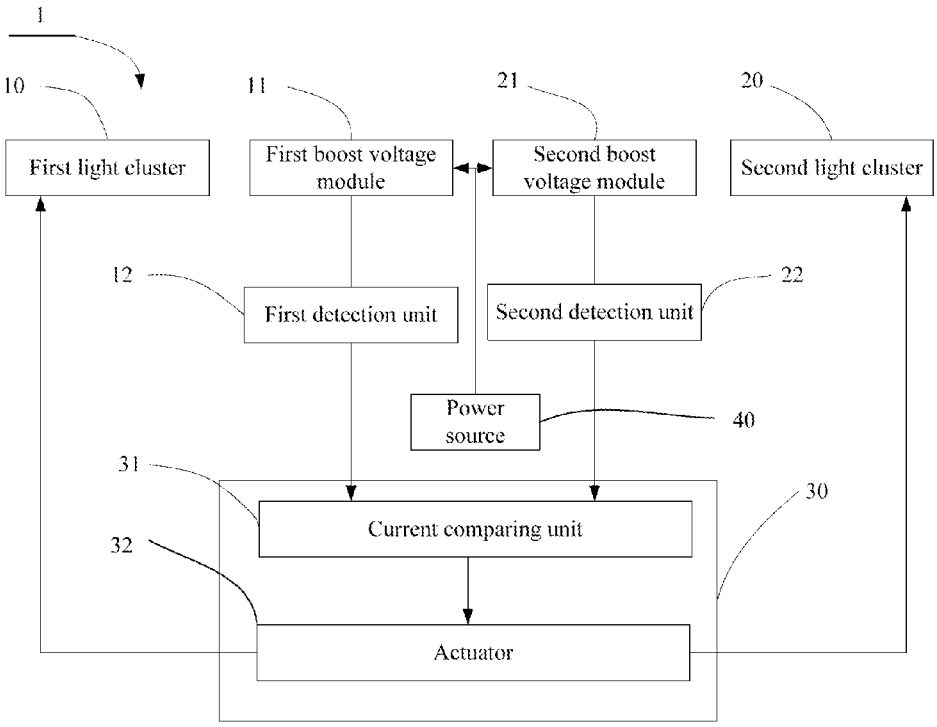
FIG. 1 is a block diagram of as light emitting diode (LED) backlight driving circuit of the present disclosure.

The present disclosure provides a liquid crystal display (LCD) device comprising a liquid crystal (LC) panel and a backlight module. As shown in FIG. 1, the backlight module comprises a light emitting diode (LED) backlight driving circuit 1 comprising a monitor module 30, a first light cluster 10, a first boost voltage module 11 that drives the first light cluster 10, a second light cluster 20, and a second boost voltage module 21 that drives the second light cluster 20. The first boost voltage module 11 comprises a first detection unit 12 detecting an output current of the first boost voltage module 11, and the second boost voltage module 21 comprises a second detection unit 22 detecting an output current of the second boost voltage module 21. The monitor module 30 comprises a current comparing unit 31 coupled to the first detection unit 12 and the second detection unit 22, and an actuator 32 coupled to the current comparing unit 31. The actuator controls running states of the first boost voltage module 11 and the second boost voltage module 21. The running state the first boost voltage module and the second boost voltage module is a working state or a turn-off state of the first boost voltage module and the second boost voltage module. The first light cluster Wand the second light cluster 20 may be one LED lightbar or more LED lightbars connected in parallel.

Figure 2:
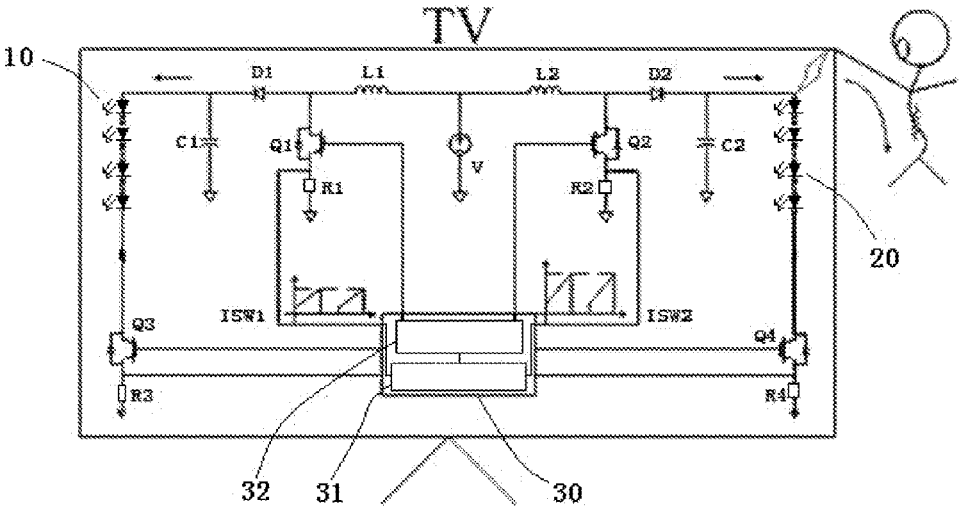
FIG. 2 is a schematic diagram of a first example of the present disclosure.

The present disclosure provides two light clusters comprising the LED lightbar, and the two light clusters are respectively driven using two boost voltage modules, and then the current comparing unit 31 of the monitor module 30 compares waveforms of the output currents of the two boost voltage modules. When the LED backlight driving circuit normally works, a difference value between the load current of the first light cluster and the load current of the second light cluster is substantially constant, namely current ISW1 detected by the first detection unit 12 and current ISW2 detected by the second detection unit 22 are substantially equal, and it is determined that the LED backlight module normally works when the difference value between the current ISW1 and the current ISW2 is little through comparison of the monitor module 30. When output of the first light cluster or the second light cluster leaks electrical current, load of a branch circuit of the corresponding light cluster increases if the user touches the LCD device (e.g. a television TV), and the waveform detected by the corresponding detection unit increases (voltage of the ISW2 is more than voltage of the ISW1, as shown in FIG. 2). The current comparing unit 31 of the monitor determines that the backlight module is leaking electrical current, thus the backlight module enters into the protection state, and the output of the backlight module is turned off, which protects the user.

The present disclosure provides two light clusters comprising the LED lightbar, and the two light clusters are respectively driven by two boost voltage modules. The current comparing unit of the monitor module compares waveforms of the output currents of the two boost voltage modules. When the LED backlight driving circuit normally works, a difference value between a load current of the first light cluster and a load current of the second light cluster is substantially constant. When one of the two light clusters is in an electrical leakage state, the output current of the boost voltage module corresponding to the light cluster of the electrical leakage increases. The output current of the other boost voltage module corresponding to the light cluster having, no electrical leakage is not changed, thus the difference value between the load current of the first light cluster and the load current of the second light cluster increases. It is determined whether the light cluster is in the electrical leakage state or not through the above method. When the LED backlight driving circuit is in the electrical leakage state, the boost voltage module turns off, thereby protecting the user.

The present disclosure is particularly suitable for the LCD device comprising a plurality of LED lightbars connected in parallel. When the LCD device is the electrical leakage state, voltage and current of each of the LED lightbars may be not changed, however, a total output current of the LED lightbars of one light cluster increases. Thus, the electrical leakage is not accurately determined when only the voltage and current of each of the lightbars are detected. The present disclosure uses the plurality of the LED lightbars as one light cluster, and determines the electrical leakage state through detecting the output current of the light cluster, thereby improving accuracy.

The present disclosure will further be described in detail in accordance with the figures and the exemplary examples.

EXAMPLE 1

As shown in FIG. 1 and FIG. 2, an LED backlight driving circuit 1 of a first example comprises a monitor module 30, a first light cluster 10, a first boost voltage module 11 driving the first light cluster 10, a second light, cluster 20, and a second boost voltage module 21 driving the second light cluster 20. A resistance value of the first light cluster 10 is equal to a resistance value of the second light cluster 20. The first boost voltage module 11 comprises a first detection unit 12 detecting an output current of the first boost voltage module 11, and the second boost voltage module 21 comprises a second detection unit 22 detecting an output current of the second boost voltage module 21. The monitor module 30 comprises a current comparing unit 31 coupled to the first detection unit 12 and the second detection unit 22, and an actuator 32 coupled to the current comparing unit 31. The actuator controls a running state of the first boost voltage module 11 and the second boost voltage module 21. The first light cluster 10 and the second light cluster 20 may be LED lightbar or more LED lightbars connected in parallel.

The LED backlight driving circuit 1 comprises a power source 40. The first boost voltage module 11 comprises a first inductor L1 and a first diode D1, where the first inductor L1 and the first diode D1 are connected between the power source 40 and the first light cluster 10 in series. An anode of the first diode D1 is coupled to the first inductor L1 and is connected to a first adjusting voltage switch Q1. A cathode of the first diode D1 is coupled to the first light cluster 10, and a first capacitor C1 is connected between the cathode of the first diode D1 and a ground end of the LED backlight driving circuit. The first detection unit comprises a first resistor R1 connected between the first adjusting voltage switch Q1 and the ground end of the LED backlight driving circuit in series. A first end of the first resistor R1 connected to the adjusting voltage switch Q1 is coupled to the current comparing, unit 31 of the monitor module 30. A control end of the first adjusting voltage switch Q1 is coupled to the monitor module 30. The second boost voltage module comprise a second inductor L2 and a second diode D2, where the second inductor L2 and the second diode D2 are connected between the power source 40 and the second light cluster 20 in series. An anode of the second diode D2 is coupled to the second inductor L2 and is connected to a second adjusting voltage switch Q2. A cathode of the second diode D2 is coupled to the second light cluster 20, and a second capacitor C2 is connected between the cathode of the second diode D2 and the ground end of the LED backlight driving circuit. The second detection unit comprises a second resistor R2 connected between the second adjusting voltage switch Q2 and the ground end of the LED backlight driving circuit in series. A first end of the second resistor R2 connected to the second adjusting voltage switch Q2 is coupled to the current comparing unit 31 of the monitor module 30. A control end of the second adjusting voltage switch Q2 is coupled to the monitor module 30.

In order to add a dimming function, a third dimming switch Q3 and a third resistor R3 are connected between the first light cluster 10 and the ground end of the LED backlight driving circuit in series. A control end and an output end of the third dimming switch Q3 are coupled to the monitor module 30. A fourth dimming switch Q4 and a fourth resistor R4 are connected between the second light cluster 20 and the ground end of the LED backlight driving circuit in series. A control end and an output end of the fourth dimming switch Q4 are coupled to the monitor module 30.

The first example is particularly suitable for to the LED backlight driving circuit of the LCD device using a method for illuminating the LCD device from the two sides of the LCD device, namely the first light cluster and the second light cluster are arranged on two opposite sides of the LCD device, respectively, and the light enters into the LCD device from the two opposite sides of a liquid crystal panel of the LCD device.

The present disclosure provides two light clusters comprising the LED lightbar, and the two light clusters are respectively driven using two boost voltage modules, and then the current comparing unit 31 of the monitor module 30 compares waveforms of the output currents of the two boost voltage modules. When the LED backlight driving circuit normally works, a difference value between the load current of the first light cluster and the load current of the second light cluster is substantially constant, namely the difference value between current ISW1 detected by the first detection unit 12 and current ISW2 detected by the second detection unit 22 is little, and it is determined that the LED backlight module normally works when the difference value between the current ISW1 and the current ISW2 is little through comparison of the monitor module 30. When output of the first light cluster or the second light cluster leaks electrical current, load of a branch circuit of the corresponding light cluster increases if the user touches the LCD device (i.e. a television TV), and the waveform detected by the corresponding detection unit increases (voltage of the ISW2 is more than voltage of the ISW1, as shown in FIG. 2). The current comparing unit 31 of the monitor determines that the backlight module is leaking electrical current, thus the backlight module enters into the protection state, and the output of the backlight module is turned off, which protects the user According to Ohm's law, when resistance and voltage are same, current is also same, thus the present disclosure uses the resistance value of the first light cluster is equal to the resistance value of the second light cluster. Regardless of brightness of the light cluster in the normally working state, the difference value between the load current of the first light cluster and the load current of the second light cluster may be zero, namely reference value is constant. As long as one of the two light clusters leaks electrical current, the difference value between the load current of the first light cluster and the load current of the second light cluster may not be zero. Thus, when the difference value between the load current of the first light cluster and the load current of the second light cluster may not be zero, it is determined that the LCD device is in the electrical leakage state, thus reducing error determination.

EXAMPLE 2

Figure 3:
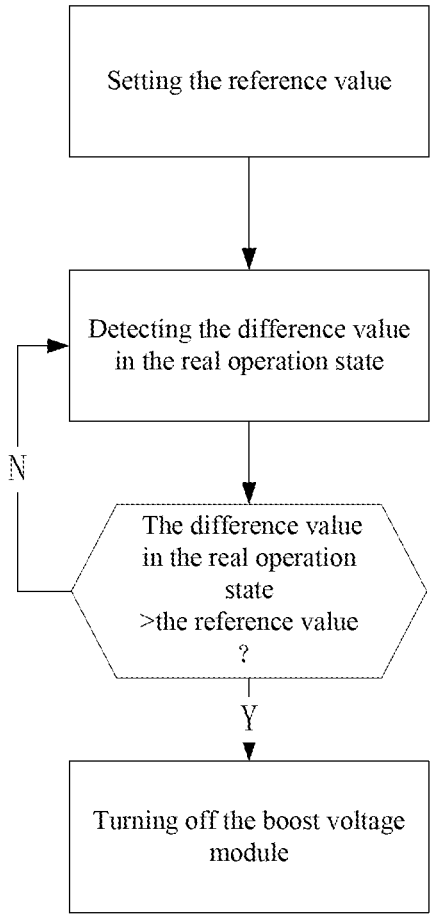
FIG. 3 is a flowchart of a method of a second example of the present disclosure.

As shown in FIG. 3, the present disclosure provides a method for driving an LED backlight driving circuit comprising:

A: detecting; as difference value of current between a first detection unit and a second detection unit in a normally working state, and setting the difference value as a reference difference value.

B: detecting the difference value of current between the first detection unit and the second detection unit in a working state. If the difference value is more than the reference difference value, outputs of the first boost voltage module and the second boost voltage module are turned off, and if the difference value is equal to the reference difference value, returning to the step B.

The step A comprises: detecting the difference value of current between the first detection unit and the second detection unit in a maximum brightness state of the LED lightbar, and setting the difference value as the reference value. When brightness of the LED lightbar is at a maximum value, currents of a first light cluster and a second light cluster are maximum, thus the difference value of current between the first light cluster and the second light cluster set as the reference difference value is at a maximum, if the difference value of between current of the first detection unit and current of the second detection unit in the working state exceeds the reference difference value, the electrical leakage of the LCD device is substantially determined, which improves accuracy of determination and reduces error determination.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A light emitting diode (LED) backlight driving circuit, comprising:

a monitor module;

a first light cluster;

a first boost voltage module driving the first light cluster;

a second light cluster; and a second boost voltage module driving the second light cluster;

wherein the first boost voltage module comprises a first detection unit that detects an output current of the first boost voltage module, and the second boost voltage module comprises a second detection unit that detects an output current of the second boost voltage module;

wherein the monitor module comprises a current comparing unit coupled to the first detection unit and the second detection unit, and an actuator coupled to the current comparing unit; the actuator controls running states of the first boost voltage module and the second boost voltage module, when a difference value of output current between the first detection unit and the second detection unit is more than a reference difference value, the first boost voltage module and the second boost voltage module are turned off.

2. The LED backlight driving circuit of claim 1, wherein a resistance value of the first light cluster is equal to a resistance value of the second light cluster.

3. The LED backlight driving circuit of claim 2, wherein the first light cluster is same as the second light cluster.

4. The LED backlight driving circuit of claim 1, further comprising a power source; wherein the first boost voltage module comprises a first inductor and a first diode, the first inductor and the first diode are connected between the power source and the first light cluster in series;

wherein an anode of the first diode is coupled to the first inductor and is connected to a first adjusting voltage switch; a cathode of the first diode is coupled to the first light cluster, and a first capacitor is connected between the cathode of the first diode and a ground end of the LED backlight driving circuit;

wherein the first detection unit comprises a first resistor connected between the first adjusting voltage switch and the ground end of the LED backlight driving circuit in series; a first end of the first resistor that connected to the adjusting voltage switch is coupled to the current comparing unit of the monitor module; a control end of the first adjusting voltage switch is coupled to the monitor module;

wherein the second boost voltage module comprises a second inductor and a second diode, the second inductor and the second diode are connected between the power source and the second light cluster in series; an anode of the second diode is coupled to the second inductor and is connected to a second adjusting voltage switch; a cathode of the second diode is coupled to the second light cluster, and a second capacitor is connected between the cathode of the second diode and the ground end of the LED backlight driving circuit;

wherein the second detection unit comprises a second resistor connected between the second adjusting voltage switch and the ground end of the LED backlight driving circuit in series; a first end of the second resistor that connected to the second adjusting voltage switch is coupled to the current comparing unit of the monitor module; a control end of the second adjusting voltage switch is coupled to the monitor module.

5. The LED backlight driving circuit of claim 1, wherein a third dimming switch and a third resistor are connected between the first light cluster and the ground end of the LED backlight driving circuit in series; a control end and an output end of the third dimming switch are coupled to the monitor module; a fourth dimming switch and a fourth resistor are connected between the second light cluster and the ground end of the LED backlight driving circuit in series; a control end and an output end of the fourth dimming switch are coupled to the monitor module.

6. The LED backlight driving circuit of claim 1, further comprising a power source; wherein a resistance value of the first light cluster is equal to a resistance value of the second light cluster; the first light cluster is same as the second light cluster;

wherein the first boost voltage module comprises a first inductor and a first diode; the first inductor and the first diode are connected between the power source and the first light cluster in series;

wherein an anode of the first diode is coupled to the first inductor and is connected to a first adjusting voltage switch; a cathode of the first diode is coupled to the first light cluster, and a first capacitor is connected between the cathode of the first diode and a ground end of the LED backlight driving circuit;

wherein the first detection unit comprises a first resistor connected between the first adjusting voltage switch and the ground end of the LED backlight driving circuit in series; a first end of the first resistor that connected to the adjusting voltage switch is coupled to the current comparing unit of the monitor module; a control end of the first adjusting voltage switch is coupled to the monitor module;

wherein the second boost voltage module comprises a second inductor and a second diode, the second inductor and the second diode are connected between the power source and the second light cluster in series; an anode of the second diode is coupled to the second inductor and is connected to a second adjusting voltage switch; a cathode of the second diode is coupled to the second light cluster, and a second capacitor is connected between the cathode of the second diode and the ground end of the LED backlight driving circuit;

wherein the second detection unit comprises a second resistor connected between the second adjusting voltage switch and the ground end of the LED backlight driving circuit in series; a first end of the second resistor that connected to the second adjusting voltage switch is coupled to the current comparing unit of the monitor module; a control end of the second adjusting voltage switch is coupled to the monitor module;

a third dimming switch and a third resistor are connected between the first light cluster and the ground end of the LED backlight driving circuit in series; a control end and an output end of the third dimming switch are coupled to the monitor module; a fourth dimming switch and a fourth resistor are connected between the second light cluster and the ground end of the LED backlight driving circuit in series; a control end and an output end of the fourth dimming switch are coupled to the monitor module.

7. A method for driving an LED backlight driving circuit claim 1, comprising:

A: detecting a difference value of current between a first detection unit and a second detection unit in a normally working state, and setting the difference value as a reference difference value;

B: detecting the difference value of current between the first detection unit and the second detection unit in a working state; if the difference value is more than the reference difference value, the first boost voltage module and the second boost voltage module are turned off, and if the difference value is equal to the reference difference value, returning to the step B.

8. The method for driving the LED backlight driving circuit of claim 7, wherein the step A comprises:

detecting the difference value of current between the first detection unit and the second detection unit in a maximum brightness state of the LED lightbar, and setting the difference value as the reference value.

9. A liquid crystal display (LCD) device, comprising:

a light emitting diode (LED) backlight driving circuit;

wherein the LED backlight driving circuit comprises a monitor module, a first light cluster, a first boost voltage module that drives the first light cluster, a second light cluster, and a second boost voltage module that drives the second light cluster;

wherein the first boost voltage module comprises a first detection unit that detects an output current of the first boost voltage module, and the second boost voltage module comprises a second detection unit that detects an output current of the second boost voltage module;

wherein the monitor module comprises a current comparing unit coupled to the first detection unit and the second detection unit, and an actuator coupled to the current comparing unit; the actuator controls running states of the first boost voltage module and the second boost voltage module, when a difference value of output current between the first detection unit and the second detection unit is more than a reference difference value, the first boost voltage module and the second boost voltage module are turned off.

10. The LCD device of claim 9, wherein a resistance value of the first light cluster is equal to a resistance value of the second light cluster.

11. The LCD device of claim 10, wherein the first light cluster is same as the second light cluster.

12. The LCD device of claim 9, wherein further comprising a power source; wherein the first boost voltage module comprises a first inductor and a first diode; the first inductor and the first diode are connected between the power source and the first light cluster in series;

wherein an anode of the first diode is coupled to the first inductor and is connected to a first adjusting voltage switch; a cathode of the first diode is coupled to the first light cluster, and a first capacitor is connected between the cathode of the first diode and a ground end of the LED backlight driving circuit;

wherein the first detection unit comprises a first resistor connected between the first adjusting voltage switch and the ground end of the LED backlight driving circuit in series; a first end of the first resistor that connected to the adjusting voltage switch is coupled to the current comparing unit of the monitor module; a control end of the first adjusting voltage switch is coupled to the monitor module;

wherein the second boost voltage module comprises a second inductor and a second diode, the second inductor and the second diode are connected between the power source and the second light cluster in series; an anode of the second diode is coupled to the second inductor and is connected to a second adjusting voltage switch; a cathode of the second diode is coupled to the second light cluster, and a second capacitor is connected between the cathode of the second diode and the ground end of the LED backlight driving circuit;

wherein the second detection unit comprises a second resistor connected between the second adjusting voltage switch and the ground end of the LED backlight driving circuit in series; a first end of the second resistor that connected to the second adjusting voltage switch is coupled to the current comparing unit of the monitor module; a control end of the second adjusting voltage switch is coupled to the monitor module.

13. The LCD device of claim 9, wherein a third dimming switch and a third resistor are connected between the first light cluster and the mound end of the LED backlight driving circuit in series; a control end and an output end of the third dimming switch are coupled to the monitor module; a fourth dimming switch and a fourth resistor are connected between the second light cluster and the ground end of the LED backlight driving circuit in series; a control end and an output end of the fourth dimming switch are coupled to the monitor module.

14. The LCD device of claim 9, further comprising a power source; wherein a resistance value of the first light cluster is equal to a resistance value of the second light cluster; the first light cluster is same as the second light cluster;

wherein the first boost voltage module comprises a first inductor and a first diode; the first Inductor and the first diode are connected between the power source and the first light cluster in series;

wherein an anode of the first diode is coupled to the first inductor and is connected to a first adjusting voltage switch; a cathode of the first diode is coupled to the first light cluster, and a first capacitor is connected between the cathode of the first diode and a ground end of the LED backlight driving circuit;

wherein the first detection unit comprises a first resistor connected between the first adjusting voltage switch and the ground end of the LED backlight driving circuit in series; a first end of the first resistor that connected to the adjusting voltage switch is coupled to the current comparing unit of the monitor module; a control end of the first adjusting voltage switch is coupled to the monitor module;

wherein the second boost voltage module comprises a second inductor and a second diode, the second inductor and the second diode are connected between the power source and the second light cluster in series; an anode of the second diode is coupled to the second inductor and is connected to a second adjusting voltage switch; a cathode of the second diode is coupled to the second light cluster, and a second capacitor is connected between the cathode of the second diode and the ground end of the LED backlight driving circuit;

wherein the second detection it comprises a second resistor connected between the second adjusting voltage switch and the ground end of the LED backlight driving circuit in series; a first end of the second resistor that connected to the second adjusting voltage switch is coupled to the current comparing unit of the monitor module; a control end of the second adjusting voltage switch is coupled to the monitor module;

a third dimming switch and a third resistor are connected between the first light cluster and the ground end of the LED backlight driving circuit in series; as control end and an output end of the third dimming switch are coupled to the monitor module; a fourth dimming switch and a fourth resistor are connected between the second light cluster and the ground end of the LED backlight driving circuit in series; a control end and an output end of the fourth dimming switch are coupled to the monitor module.

15. The LCD device of claim 9, further comprising a liquid crystal panel, the first light cluster and the second light cluster are arranged on two opposite sides of the liquid crystal panel.

* * * * *